US007721647B2

(12) United States Patent
Strauss et al.

(10) Patent No.: US 7,721,647 B2
(45) Date of Patent: May 25, 2010

(54) APPARATUS AND METHOD FOR CLEANING A WEBBING-UP DEVICE IN A PRINTING PRESS

(75) Inventors: Michael Strauss, Vogtlaendisches Oberland-Hohndorf (DE); Bodo Theeg, Plauen (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 104 days.

(21) Appl. No.: 12/013,724

(22) Filed: Jan. 14, 2008

(65) Prior Publication Data

US 2008/0173198 A1 Jul. 24, 2008

(30) Foreign Application Priority Data

Jan. 15, 2007 (DE) ..... 10 2007 002 875

(51) Int. Cl.
*B41F 35/00* (2006.01)

(52) U.S. Cl. ..... 101/425; 101/483

(58) Field of Classification Search ..... 101/425, 101/483

See application file for complete search history.

(56) References Cited

U.S. PATENT DOCUMENTS

| | | | | | |
|---|---|---|---|---|---|
| 5,052,295 | A | * | 10/1991 | Suzuki et al. | 101/227 |
| 5,201,269 | A | * | 4/1993 | Eckert | 101/228 |
| 5,263,414 | A | * | 11/1993 | Lehrrieder et al. | 101/228 |
| 5,296,982 | A | * | 3/1994 | Terada et al. | 360/234.5 |
| 5,996,873 | A | * | 12/1999 | Pimpis | 226/92 |
| RE39,797 | E | * | 8/2007 | Munz | 101/425 |
| 7,387,601 | B2 | * | 6/2008 | Beck et al. | 493/254 |
| 2003/0140942 | A1 | * | 7/2003 | Rajala et al. | 134/6 |

FOREIGN PATENT DOCUMENTS

| | | |
|---|---|---|
| DE | 203 867 | 11/1983 |
| DE | 93 20 257.1 U1 | 4/1994 |

* cited by examiner

*Primary Examiner*—Anthony H. Nguyen
(74) *Attorney, Agent, or Firm*—Crowell & Moring LLP

(57) ABSTRACT

An apparatus and method for cleaning a webbing-up device in a printing press is disclosed. A webbing-up device for webbing up a printing substrate web in a printing press, namely in a web-fed printing press, includes a finite conveyor chain, which is made up of several chain segments that are connected to one another in an articulated manner, and which is guided into a chain guide rail. A cleaning device, which is detachably connected to the conveyor chain, is allocated to at least one end of the finite conveyor chain.

19 Claims, 2 Drawing Sheets

APPARATUS AND METHOD FOR CLEANING A WEBBING-UP DEVICE IN A PRINTING PRESS

This application claims the priority of German Patent Document No. 10 2007 002 875.1, filed Jan. 15, 2007, the disclosure of which is expressly incorporated by reference herein.

BACKGROUND AND SUMMARY OF THE INVENTION

The invention relates to a webbing-up device for webbing up a printing substrate web in a printing press, namely in a web-fed printing press.

A device for webbing up a printing substrate web in a web-fed printing press is known from German Patent Document DD 203 867 B, whereby, when setting up a web-fed printing press, this type of webbing-up device pulls a web-like printing substrate starting from a roller splicer through the printing units of the web-fed printing press. According to DD 203 867 B, the webbing-up device includes a finite webbing-up belt, which is conveyed by a drive roller to a take-up spool. In addition to webbing-up devices based on webbing-up belts, webbing-up devices are also known that are based on a finite conveyor chain, whereby the finite conveyor chain is made up of several chain segments connected to one another in an articulated manner, and whereby the conveyor chain is guided into a chain guide rail. In this regard, reference is made to Helmut Kipphan's *Handbook of Print Media,* Page 278, Springer Verlag, Year 2000.

The present invention relates to a webbing-up device for webbing up a printing substrate web in a printing press with a finite conveyor chain, which is guided into a chain guide rail. The chain guide rail is preferably installed throughout the entire printing press, whereby dirt can get deposited in the chain conveyor rail during printing operation, which can impede the malfunction-free transport of the conveyor chain of the webbing-up device through the chain guide rail during a subsequent set-up operation. This is a disadvantage.

Starting herefrom, the present invention is based on the objective of creating a novel webbing-up device for webbing up a printing substrate web in a printing press.

According to the invention, a cleaning device, which is detachably connected to the conveyor chain, is allocated to at least one end of the finite conveyor chain.

In terms of the present invention, a cleaning device, which is detachably connected to the conveyor chain, is allocated to at least one end of the finite conveyor chain. The cleaning device can be used to safely remove dirt that gets deposited during printing operation in the chain guide rail. As a result of this, malfunction-free operation of the conveyor chain is always guaranteed.

Preferred developments of the invention are yielded from the following description. Without being limited hereto, exemplary embodiments of the invention are explained in greater detail on the basis of the drawings.

DETAILED DESCRIPTION OF THE DRAWINGS

Figure 1:
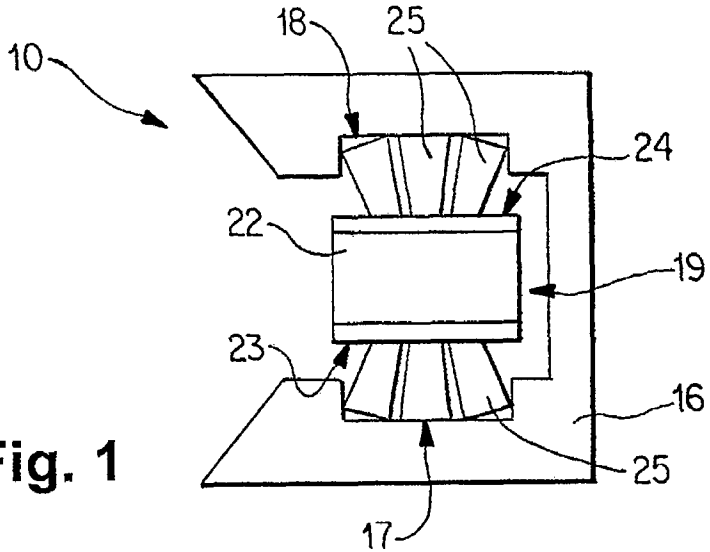
FIG. 1 is a schematic view of an inventive webbing-up device for webbing up a printing substrate web in a printing press.
Figure 2:
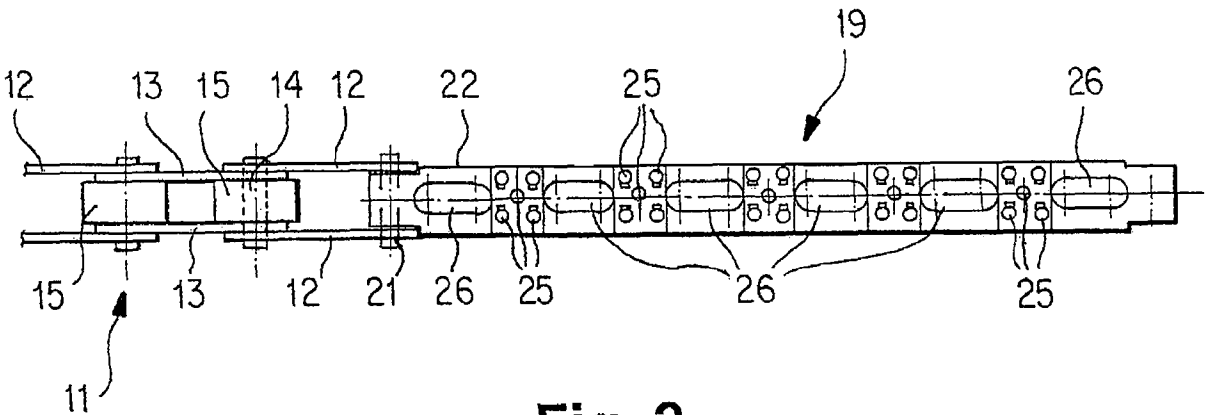
FIG. 2 illustrates a conveyor chain of the inventive device.
Figure 3:
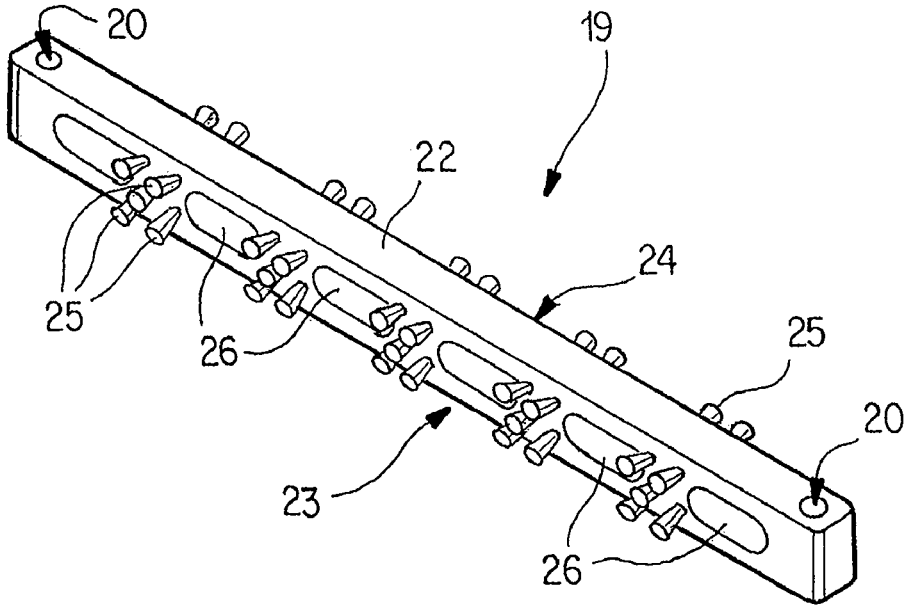
FIG. 3 illustrates a cleaning device allocated to the conveyor device.

FIGS. 1 through 3 show a preferred exemplary embodiment of a inventive webbing-up device 10 for webbing up a printing substrate web in a web-fed printing press, whereby the inventive webbing-up device 10 is comprised of a finite conveyor chain 11 (a portion of which is shown in FIG. 2). The conveyor chain 11 is made up of several chain segments connected to one another in an articulated manner. The chain segments are formed of outer links 12 and inner links 13 arranged in an alternating manner, whereby inner links 13 are connected to outer links 12 in an articulated manner via chain joints. Each chain joint includes a chain pin 14, which extends through overlapping ends of the outer links 12 and inner links 13 as well as through a runner 15 of the conveyor chain 11. FIG. 2 shows only two of these types of runners 15 of the conveyor chain 11.

The conveyor chain 11 of the webbing-up device 10 is guided into a chain guide rail 16, which is has a C-shaped contour in the depicted exemplary embodiment. The chain guide rail 16 is comprised of running surfaces 17 and 18, on which the runners 15 of the conveyor chain 11 roll when the webbing-up device 10 is in operation. Conveyor chain drive wheels (not shown) are used to transport the conveyor chain 11 along the chain guide rail 16, whereby preferably one conveyor chain drive wheel is positioned along the chain guide rail 16 on each of the defined positions of the chain guide rail.

In terms of the present invention, a cleaning device 19, which is connected to the conveyor chain 11 in a detachable as well as articulated manner, is allocated to at least one end of the conveyor chain 11 of the webbing-up device 10. According to FIG. 2, a fastening pin 21 extends through the two lateral outer links 12 of the conveyor chain 11 as well as through an opening 20 of the cleaning device 19 so as to connect the cleaning device 19 to one end of the conveyor chain 11 in a detachable as well as articulated manner.

The cleaning device 19 features a rod-like and/or rectangular basic body 22. In the depicted exemplary embodiment, cleaning bodies 25 are allocated to two opposing side walls 23 and 24 of the basic body 22. The opposing running surfaces 17 and 18 of the chain guide rail 16 for the run wheels 15 of the conveyor chain 11 can be cleaned with the assistance of the cleaning bodies 25.

The basic body 22 of the cleaning device 19 is embodied of a material, which, on the one hand, is flexible enough for the basic body 22 and thus the cleaning device 19 to pass or run through all radii and/or curves and/or twists of the chain guide rail 16 without a problem and which, on the other hand, is rigid enough to securely accommodate the cleaning bodies 25 and absorb the mechanical stress that arises. The basic body is preferably fabricated of a plastic.

In the exemplary embodiment in FIGS. 1 through 3, the cleaning bodies 25 are embodied of several bristles. The bristles in the bundle of bristles are preferably plastic bristles or wire bristles. Bristles and basic bodies made of a heat-resistant material are used in regions where high temperatures predominate.

Openings 26 are made in the basic body 22 of the cleaning device 19, in which the conveyor chain drive wheels can engage during transport of the conveyor chain 11 and thus the cleaning device 19 along the chain guide rail 16. According to FIGS. 2 and 3, several cleaning bodies 25 embodied as bundles of bristles are respectively positioned between adjacent openings 26.

As can be seen best in FIG. 1, the bristles of the center bundle of bristles extend approximately perpendicularly to the side walls 23 and 24 of the basic body 22.

The bristles of the lateral bundle of bristles, on the other hand, are set diagonally relative to the side walls 23 and 24 in order to also be able to securely clean the edges and/or corners of the running surfaces 17 and 18 of the chain guide rail 16.

As already explained, the cleaning device 19 is fastened at one end to an end of the finite conveyor chain 11. The printing substrate web is fastened to the conveyor chain. However, it is also technically realizable to fasten the printing substrate web to the cleaning device 19.

Figure 4:
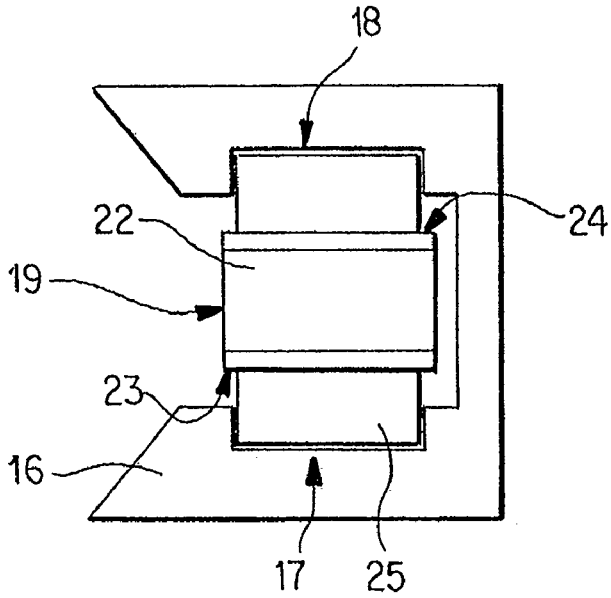
FIG. 4 is a schematic view of an alternative inventive webbing-up device for webbing up a printing substrate web in a printing press.

In the exemplary embodiment in FIGS. 1 through 3, the cleaning bodies 25 are embodied as bundles of bristles. Attention is called to the fact that other cleaning bodies can also be used, e.g., flexible strippers or cleaning bodies embodied as rigid scrapers. Thus, FIG. 4 depicts an embodiment of the inventive webbing-up device in which the cleaning bodies 25 are embodied as rigid scrapers. The rigid scrapers preferably have sharp, knife-like tips, which can be used to scrape off dirt from the running surfaces 17 and 18.

It is just as possible to allocate cleaning bodies that are embodied in different ways to the side walls 23 and 24 of the basic body 22 of the cleaning device 19. As a result, it is then possible to loosen dirt from the running surfaces 17 and 18 of the chain guide rail 16 using the first cleaning bodies, e.g., via strippers or scrapers, and to gather up or carry away the loosened dirt with the second cleaning bodies, e.g., bundles of bristles.

Because of the fact that the cleaning device 19 is connected in a detachable manner to one end of the finite conveyor chain 11, the cleaning device can be easily assembled and disassembled from the conveyor chain 11.

As a result, it is possible to use the cleaning device 19 in a targeted manner, e.g., only in defined sections of the chain guide rail 16, in order to prevent dirt from one area of the chain guide rail 16 from getting into another area of the chain guide rail via the cleaning device 19 and thereby enabling the different dirt particles that are accumulating in the different areas to blend into a mixture, which is harder to remove than the individual dirt particles.

LIST OF REFERENCE NUMERALS

10 Webbing-up device
11 Conveyor chain
12 Outer link
13 Inner link
14 Chain pin
15 Runner
16 Chain guide rail
17 Running surface
18 Running surface
19 Cleaning device
20 Opening
21 Fastening pin
22 Basic body
23 Side wall
24 Side wall
25 Cleaning body
26 Opening The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A webbing-up device for webbing up a printing substrate web in a printing press, comprising:

a finite conveyor chain, which is made up of several chain segments that are connected to one another in an articulated manner, a chain guide rail, wherein the finite conveyor chain is guided in the chain guide rail, a cleaning device, wherein the cleaning device is detachably connected to the finite conveyor chain and is allocated to at least one end of the finite conveyor chain, and a printing substrate web, wherein the printing substrate web is connected to a second end of the finite conveyor chain, wherein the finite conveyor chain with the connected cleaning device and the connected printing substrate web is movable through the chain guide rail during a webbing up process in the printing press.

2. The webbing-up device according to claim 1, wherein the cleaning device features a rod-like or rectangular basic body, and further comprising cleaning bodies allocated to at least two opposing side walls of the basic body, and wherein the cleaning bodies respectively engage with opposing running surfaces of the chain guide rail.

3. The webbing-up device according to claim 2, wherein the basic body is embodied of A material which is flexible such that the basic body is passable through all radii and/or curves of the chain guide rail and which is rigid such that the basic body securely accommodates the cleaning bodies.

4. The webbing-up device according to claim 2, wherein the cleaning bodies are embodied as bundles of bristles.

5. The webbing-up device according to claim 2, wherein the cleaning bodies are embodied as flexible strippers.

6. The webbing-up device according to claim 2, wherein the cleaning bodies are embodied as rigid scrapers.

7. The webbing-up device according to claim 2, wherein the cleaning bodies include a first body with a first configuration and a second body with a second configuration.

8. The webbing-up device according to claim 2, wherein openings are defined in the basic body and further comprising conveyor chain drive wheels, wherein the openings are engageable with the conveyor chain drive wheels.

9. The webbing-up device according to claim 8, wherein the cleaning bodies are arranged on at least one side of the openings of the basic body.

10. A webbing-up device of a printing press, comprising:

a conveyor chain;

a chain guide rail;

a cleaning device coupled to an end of the conveyor chain; and a printing substrate web coupled to a second end of the conveyor chain;

wherein the conveyor chain and the cleaning device are disposed within the chain guide rail;

and wherein the conveyor chain with the coupled cleaning device and the coupled printing substrate web is movable through the chain guide rail of the webbing-up device during a webbing up process in the printing press.

11. The webbing-up device according to claim 10:

wherein the cleaning device includes a first cleaning body on a first side wall of the cleaning device and a second cleaning body on a second side wall of the cleaning device;

and wherein the first cleaning body engages with a first surface of the chain guide rail and the second cleaning body engages with a second surface of the chain guide rail.

12. The webbing-up device according to claim 11, wherein the cleaning device defines an opening and wherein the first cleaning body is disposed on a first side of the opening and the second cleaning body is disposed on a second side of the opening.

13. The webbing-up device according to claim 11, wherein the first and second cleaning bodies are a bundle of bristles.

14. The webbing-up device according to claim 11, wherein the first and second cleaning bodies are a flexible stripper.

15. The webbing-up device according to claim 11, wherein the first and second cleaning bodies are a rigid scraper.

16. The webbing-up device according to claim 11, wherein the first cleaning body has a first physical configuration and the second cleaning body has a second physical configuration, and wherein the first physical configuration is different from the second physical configuration.

17. A method of cleaning a webbing-up device of a printing press, comprising the steps of:

coupling a cleaning device to an end of a conveyor chain of the webbing-up device;

coupling a printing substrate web to a second end of the conveyor chain; and moving the conveyor chain with the coupled cleaning device and the coupled printing substrate web through a chain guide rail of the webbing-up device during a webbing up process in the printing press.

18. The method according to claim 17, wherein the step of moving the conveyor chain with the coupled cleaning device and the coupled printing substrate web through the chain guide rail of the webbing-up device cleans a first surface of the chain guide rail by a first cleaning body on a first side wall of the cleaning device and cleans a second surface of the chain guide rail by a second cleaning body on a second side wall of the cleaning device.

19. The method according to claim 17, further comprising the step of engaging an opening defined by the cleaning device with a conveyor chain drive wheel during the step of moving the conveyor chain with the coupled cleaning device and the coupled printing substrate web through the chain guide rail of the webbing-up device.

* * * * *